US005448832A

United States Patent [19]

Kanemitsu et al.

[11] Patent Number: 5,448,832

[45] Date of Patent: Sep. 12, 1995

[54] METHOD OF FORMING A BOSS ON A PLATE-LIKE METALLIC BLANK, AND METHOD OF FORMING A PULLEY FROM A METALLIC PLATE

[75] Inventors: Toshiaki Kanemitsu, Kobe; Kazuyuki Oda, Kako, both of Japan

[73] Assignee: Kabushiki Kaisha Kanemitsu, Akashi, Japan

[21] Appl. No.: 90,217

[22] PCT Filed: Jan. 10, 1992

[86] PCT No.: PCT/JP92/00016

§ 371 Date: Jul. 14, 1993

§ 102(e) Date: Jul. 14, 1993

[87] PCT Pub. No.: WO93/13891

PCT Pub. Date: Jul. 22, 1993

[51] Int. Cl.[6] ..... B21K 1/42; B21D 28/00

[52] U.S. Cl. ..... 29/892.2; 29/892.3; 72/333

[58] Field of Search ..... 29/892, 892.2, 892.3; 72/333, 335, 348, 356

[56] References Cited

U.S. PATENT DOCUMENTS

| | | | |
|---|---|---|---|
| 49,649 | 8/1865 | Patterson | 72/348 |
| 596,770 | 1/1898 | Chillingworth | 72/333 |

FOREIGN PATENT DOCUMENTS

| | | | |
|---|---|---|---|
| 56-160842 | 12/1981 | Japan . | |
| 59-47034 | 3/1984 | Japan . | |
| 61-129241 | 6/1986 | Japan . | |
| 63-63543 | 3/1988 | Japan . | |
| 3180219 | 8/1991 | Japan | 72/335 |

*Primary Examiner*—P. W. Echols
*Attorney, Agent, or Firm*—Jones, Tullar & Cooper

[57] ABSTRACT

The present invention is adapted to form, at the center of a plate-like metallic blank, a case-like boss projecting from one lateral side of the blank, by: curving the plate-like metallic blank such that the blank is convex punching a hole in the top of the curved blank: and bending an arcuate portion of the blank between an outer peripheral edge portion and a hole peripheral portion of the blank in the direction opposite to the convex direction thereof with the outer peripheral edge portion of the blank restrained from extending radially outwardly. Thus, the method of the present invention is adapted to form, with the use of a small press machine, a boss having a sufficient thickness and a sufficient projecting height even though the boss has a small inner diameter, without the thickness of the initial material reduced so much in the course of the production steps.

5 Claims, 7 Drawing Sheets

FIG. 13A
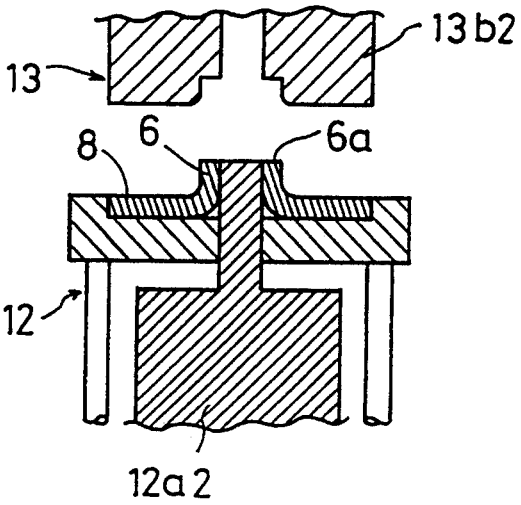
FIG. 13B
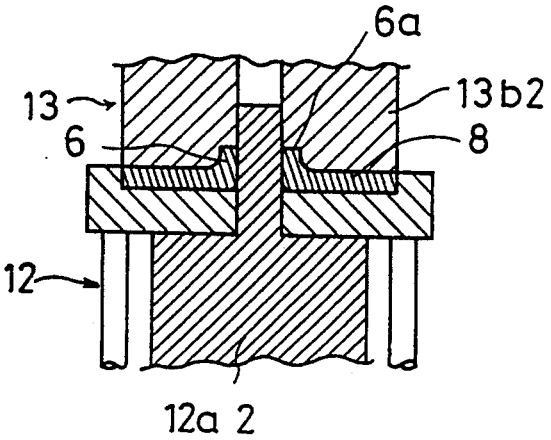
FIG. 14
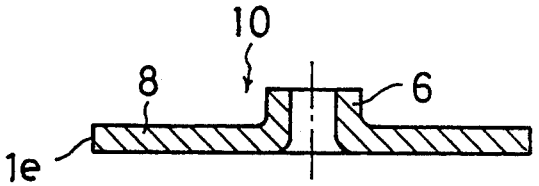
FIG. 15
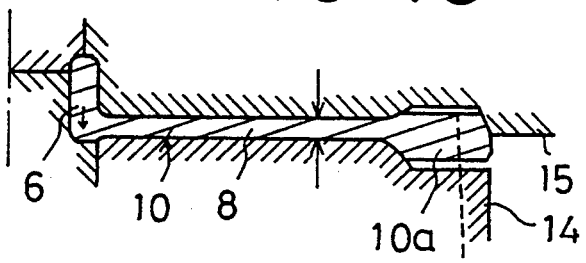
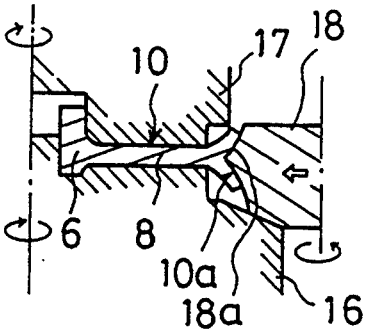
FIG. 16

METHOD OF FORMING A BOSS ON A PLATE-LIKE METALLIC BLANK, AND METHOD OF FORMING A PULLEY FROM A METALLIC PLATE

TECHNICAL FIELD

The present invention relates to a method of forming a boss on a plate-like metallic blank, as in a poly-V pulley, a crank shaft pulley or the like, by which there is integrally formed, at the center of a plate-like metallic blank, a case-like boss projecting from one lateral side of the blank, the boss being adapted to be put on a rotary body such as a rotary shaft. The present invention also relates to a method of forming a pulley from a metallic plate such as a poly-V pulley, using the first-mentioned method.

BACKGROUND ART

As a method of forming, at the center of a plate-like metallic blank, a case-like boss projecting from one lateral side of the blank, there are conventionally available a cold forging method, a drawing method, a burring method and the like.

Of these conventional methods, the cold forging method is adapted to form a case-like boss with a plastic flow of material itself utilized. Accordingly, when there is formed, from a thick plate-like metallic blank, a pulley such as a crank shaft pulley requiring a boss having a small inner diameter and a relatively great projecting height, it is difficult to form such a boss having a predetermined projecting height, even though a large-size press machine of the class of 2,000 tons to 2,500 tons is used.

In the drawing method, material flows due to drawing, so that the resulting product and particularly the boss are excessively reduced in thickness, thus failing to provide a predetermined strength.

In the burring method, there is obtained a boss having a height substantially proportional to the diameter of a hole (which corresponds to the inner diameter of the boss) to be previously punched by a punch or the like. Accordingly, there cannot be formed a boss the inner diameter of which is small and the height of which is great. Thus, the range in which a boss can be formed, is automatically limited by the relationship between the inner diameter and height thereof.

In view of the foregoing, the present invention is proposed with the objects of providing (i) a method of forming a boss on a plate-like metallic blank, capable of forming, with high precision, a boss having a desired inner diameter, a desired thickness and a desired height with the use of a small press machine without the thickness of the initial material reduced so much in the course of the production steps, and (ii) a method of forming a pulley from a metallic plate, using the first-mentioned method.

SUMMARY OF THE INVENTION

To achieve the objects mentioned above, the present invention provides a method of forming a boss on a plate-like metallic blank by which there is formed, at the center of a plate-like metallic blank, a case-like boss projecting from one lateral side of the blank. This method is characterized by comprising the steps of: curving a plate-like metallic blank such that the blank is convex in a direction in which a boss is adapted to project; punching a hole in the top of the curved blank; and bending an arcuate portion of the blank between an outer peripheral edge portion and a hole peripheral portion of the blank in the direction opposite to the convex direction thereof with the outer peripheral edge portion of the blank restrained from extending radially outwardly, so that a case-like boss is formed.

According to the method of forming a boss on a plate-like metallic blank mentioned above, each of the steps of curving a plate-like metallic blank and bending the arcuate portion of the blank as punched, is a kind of bending operation. Such a bending operation restrains the blank from being reduced in thickness due to a plastic flow of the material as done in a drawing operation. Consequently, this restrains the strength from being lowered. Further, even though the plate-like metallic blank is considerably thick, a predetermined boss can be readily formed with the use of a relatively small press machine. At the bending step, the outer peripheral edge portion of the blank is restrained from extending radially outwardly. This prevents the material from flowing outwardly and causes the material to flow mainly toward the center hole in the blank. Thus, there can be formed a boss having a sufficient thickness and a sufficient projecting height, even though the inner diameter of the boss is small. Further, since the outer peripheral edge portion of the blank is restrained from extending radially outwardly, it is possible to improve the dimensional precision of the outer diameter of a product.

According to the present invention, there may be carried out, between the curving and bending steps, a burring step of bending the hole peripheral portion such that the hole peripheral portion projects in the convex direction of the blank. Such an arrangement assures the formation of the boss at the subsequent bending step. This improves yield.

According to the present invention, there may be carried out, after the bending step, a finishing step of axially compressing the end surface of the case-like boss formed during the bending step such that the case-like boss has a predetermined projecting height. In such an arrangement, the finish precision of the boss having a predetermined projecting height is improved, and a boss portion which excessively projects over a predetermined height, can be used for thickening the boss. This further improves the strength of the boss.

The present invention provides a first method of forming a pulley from a metallic plate by which there is formed, at the center of a plate-like metallic blank, a case-like boss projecting from one lateral side of the blank, and by which V-grooves are formed in an outer peripheral wall portion of the blank. This first method is characterized by comprising the steps of: curving a plate-like metallic blank such that the blank is convex in a direction in which a boss is adapted to project; punching a hole in the top of the curved blank; bending an arcuate portion of the blank between an outer peripheral edge portion and a hole peripheral portion of the blank in the direction opposite to the convex direction thereof with the outer peripheral edge portion of the blank restrained from extending radially outwardly, so that a flat portion and a case-like boss are formed; thickening an outer peripheral wall portion of the blank by pressing the flat portion of the blank as bent, in the thickness direction thereof; and forming V-grooves in the outer peripheral wall portion thus thickened.

According to the first method of forming a pulley from a metallic plate, there can be readily formed, with high precision, the center boss having a sufficient thickness and a sufficient projecting height, with the use of a relatively small press machine, likewise in the method of forming a boss on a plate-like metal mentioned earlier. Further, after the boss forming step, the flat portion of the blank after the bending step, is pressed in the thickness direction thereof. This efficiently achieves, in one step, thinning the flat portion to cause the resulting pulley to be made lightweight and thickening the outer peripheral portion required for forming V-grooves. This minimizes the number of steps of producing a pulley made of a metallic plate, thus lowering the production cost.

The present invention provides a second method of forming a pulley from a metallic plate by which there is formed, at the center of a plate-like metallic blank, a case-like boss projecting from one lateral side of the blank, and by which V-grooves are formed in an outer peripheral wall portion of the blank. The second method is characterized by comprising the steps of: curving a plate-like metallic blank such that the blank is convex in a direction in which a boss is adapted to project; punching a hole in the top of the curved blank; bending an arcuate portion of the blank between an outer peripheral edge portion and a hole peripheral portion of the blank in the direction opposite to the convex direction thereof with the outer peripheral edge portion of the blank restrained from extending radially outwardly, so that a flat portion and a case-like boss are formed; pressing the flat portion of the blank as bent, in the thickness direction thereof such that the flat portion is so extended as to have a predetermined outer diameter; forming a peripheral wall portion on the blank by bending the outer end side of the flat portion as pressed, in one direction along the axis of rotation of the pulley; and forming V-grooves in the peripheral wall portion.

According to the second method of forming a pulley from a metallic plate, there can be readily formed, with high precision, the center boss having a sufficient thickness and a sufficient projecting height, with the use of a relatively small press machine, likewise in the method of forming a boss on a plate-like metal mentioned earlier. Further, subsequent to the boss forming step, there are carried out (i) the step of pressing the flat portion of the blank as bent, in the thickness direction thereof such that the flat portion is so extended as to have a predetermined outer diameter, and (ii) the step of forming a peripheral wall by bending the outer end side of the flat portion as pressed, in one direction along the axis of rotation. It is therefore possible to make a product pulley lightweight, as well as to make its outer diameter uniform, thus providing a lightweight and highly precise pulley made of a metallic plate.

BRIEF DESCRIPTION OF THE DRAWINGS

FIG. 13A and FIG. 13B are section views of main portions of a boss finishing step in the first method mentioned above;

FIG. 14 is a section view of a plate-like metallic blank after a boss has been formed thereon;

FIG. 15 is a half section view of main portions of a thickening step in the first method mentioned above;

FIG. 16 is a half section view of main portions of a first rotatingly forming step in the first method mentioned above;

DESCRIPTION OF THE PREFERRED EMBODIMENTS

With reference to attached drawings, the following description will discuss an embodiment of a method of forming a boss on a plate-like metallic blank according to the present invention, and more particularly a method of forming a boss of a pulley which is made of a metallic plate, which integrally has a boss, and which is used as a crank shaft pulley or the like. In this embodiment, the following description will discuss a method of forming a pulley made of a metallic plate integrally having a boss, which pulley is made from a disk-like metallic blank having a diameter of about 90 to about 100 mm and a thickness t of about 5 mm, the boss inner diameter d1 being about 12 mm, the pulley outer diameter d2 being about 80 mm and the boss projecting height h being about 35 to about 36 mm.

Figure 1A:
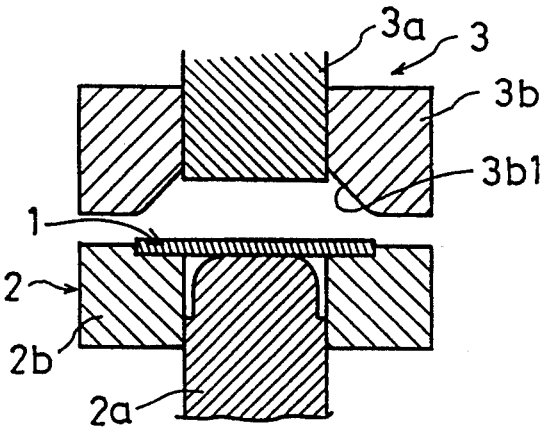
FIG. 1A and FIG. 1B are section views of the main portions of a first curving (drawing) step in a method of forming a boss on a plate-like metallic blank according to the present invention.
Figure 1B:
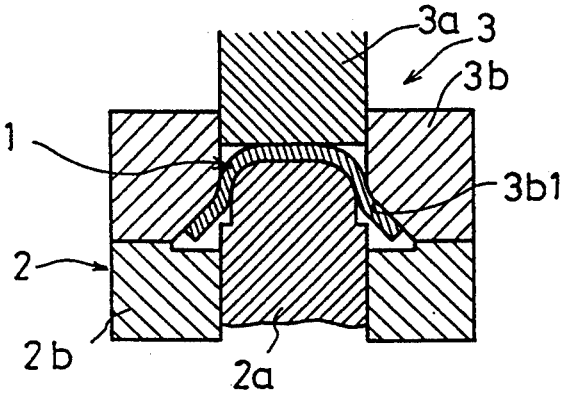

As shown in FIG. 1A in which a first curving (drawing) step is shown, a circular flat metallic blank 1 is set on a lower mold 2 having a punch 2*a* and a punch holder 2*b*, and a press machine is operated such that the lower mold 2 and an upper mold 3 having a die 3*a* and a die holder 3*b* approach each other. As shown in FIG. 1B, the metallic blank 1 is then drawn in its entirety in the boss projecting direction such that the metallic blank 1 is convexly curved in two stages. The shape in which the metallic blank 1 is curved, is determined by the tip shape of the punch 2*a* of the lower mold 2 and an inlet tapering surface 3*b*1 of the die holder 3*b* of the upper mold 3.

Figure 2A:
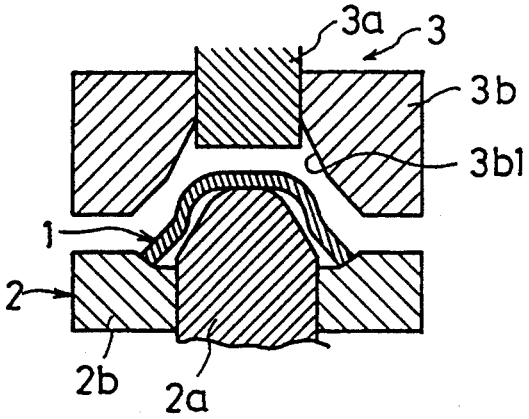
FIG. 2A and FIG. 2B are section views of main portions of a second curving (drawing) step in the method mentioned above.
Figure 2B:
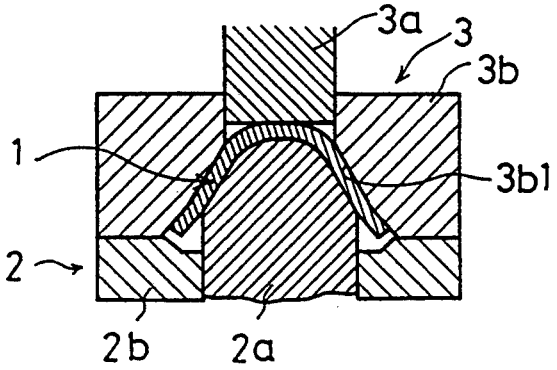

As shown in FIG. 2A and FIG. 2B in which a second curving (drawing) step is shown, there are used (i) a punch 2*a* the tip shape of which is different from that of the punch 2*a* used in the first curving (drawing) step, and (ii) a die holder 3*b* the inlet tapering surface 3*b*1 of which is different from that of the die holder 3*b* used in the first curving (drawing) step. Likewise in the first curving (drawing) step, the press machine is operated such that the upper mold 3 and the lower mold 2 approach each other, thus drawing the metallic blank 1 substantially in the form of a cone.

Figure 3:
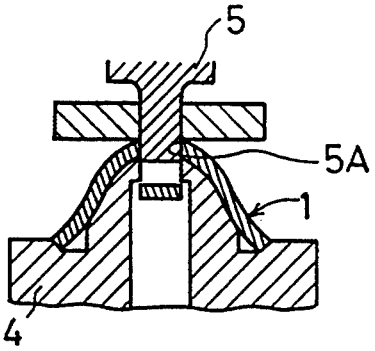
FIG. 3 is a section view of main portions of a punching step in the method mentioned above.
Figure 4A:
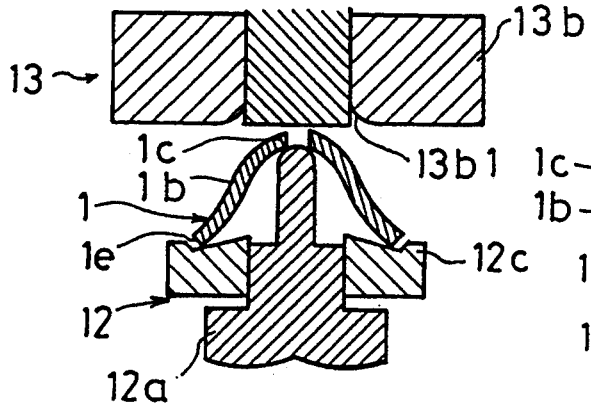
FIG. 4A and FIG. 4B are section views of main portions of a first bending (squeezing) step in the method mentioned above.
Figure 4B:
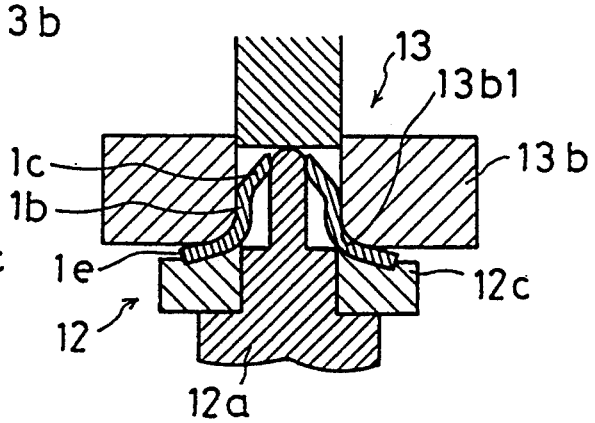
Figure 5A:
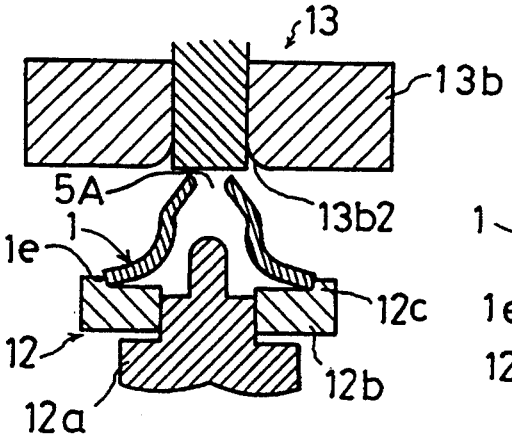
FIG. 5A and FIG. 5B are section views of main portions of a second bending (squeezing) step in the method mentioned above.
Figure 5B:
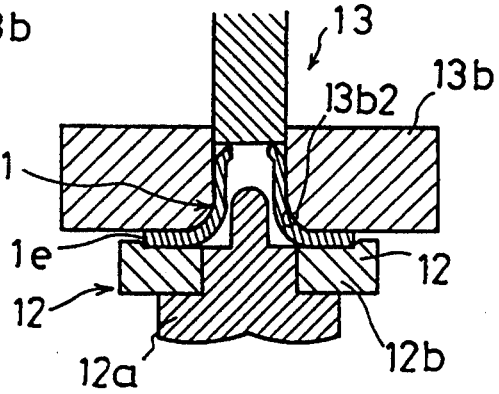
Figure 6A:
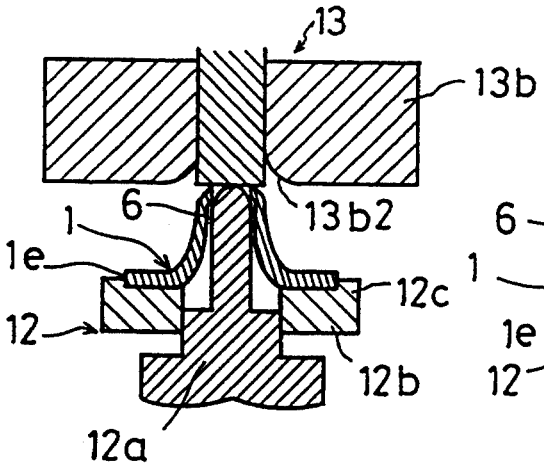
FIG. 6A and FIG. 6B are section views of main portions of a third bending (squeezing) step in the method mentioned above.
Figure 6B:
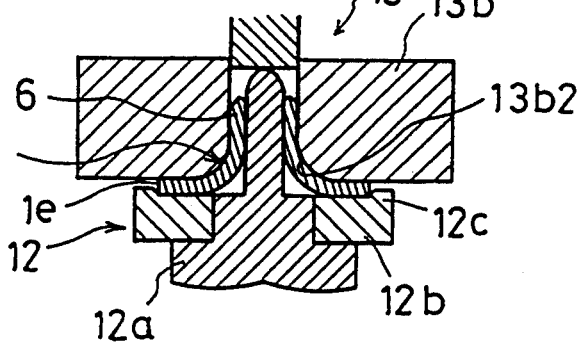
Figure 7A:
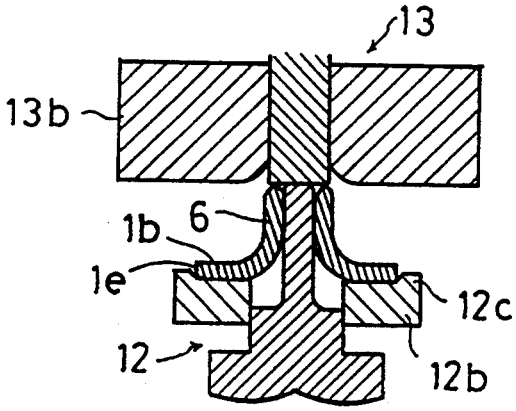
FIG. 7A and FIG. 7B are section views of main portions of a fourth bending (squeezing) step in the method mentioned above.
Figure 7B:
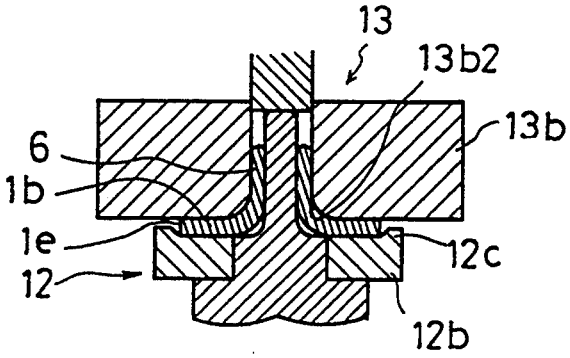

As shown in FIG. 3, the metallic blank 1 thus curved is held by a dedicated pierced holder 4, and a hole 5A having a diameter of about 7 mm is formed in the top of the metallic blank 1 with the use of a punching tool 5 such as a lathe, a drilling machine or the like.

Then, the sequence proceeds to bending (squeezing) steps for forming a case-like boss. As shown in FIG. 4A, FIG. 4B to FIG. 7A, FIG. 7B, the bending (squeezing) steps include a first to fourth steps. In each of these first to fourth steps, there are used dedicated lower and upper squeezing molds 12, 13 which are different from those used at each of the first and second curving (drawing) steps in the projecting amount and tip curvature of the punch 12*a* of each lower mold 12 and in the curvature of the inlet corner portion 13*b*2 of a die holder 13*b* of each upper mold 13. In the bending (squeezing) steps, the upper and lower molds 13, 12 are caused to approach each other so that an arcuate portion 1*b* of the blank 1 between an outer peripheral edge portion 1*e* and a hole peripheral portion 1*c* of the blank 1, is squeezed and bent in the direction opposite to the convex direction thereof. As a result, the hole peripheral portion 1*c* is deformed along the outer peripheral surface of each punch 12*a*, thus forming a case-like boss 6 at the center of the blank 1. In each of the plurality of bending steps, the outer peripheral edge portion 1*e* of the blank 1 comes in contact with the inner surface of an annular projection 12*c* of the punch holder 12*b* of each lower mold 12. Accordingly, the outer peripheral edge portion 1*e* is always restrained from extending radially outwardly. This perfectly prevents the material of the blank 1 from flowing in the radially outward direction, but causes the material of the blank 1 to flow toward the case-like boss 6. Accordingly, the case-like boss 6 can be securely thickened and the linear portion of the case-like boss 6 can be securely lengthened.

Figure 8:
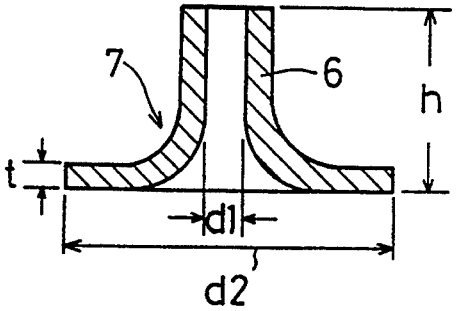
FIG. 8 is a section view of a blank made of a metallic plate after a boss has been formed thereon.

According to the steps mentioned above, there can be obtained a pulley made of a metallic plate 7 integrally having the case-like boss 6 the inner diameter d1 of which is as small as about 12 mm and the projecting height h of which is as high as about 35 to 36 mm, as shown in FIG. 8. The pulley 7 thus obtained can be effectively used as a crank shaft pulley.

As a first method of forming a pulley made of a metallic plate according to the present invention, the following will discuss a poly-V pulley forming method with reference to the attached drawings.

Figure 9A:
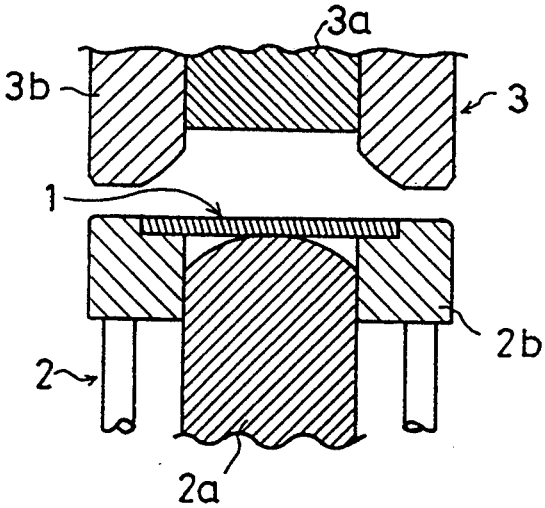
FIG. 9A and FIG. 9B are section views of main portions of a curving (drawing) step in a first method of forming a pulley from a metallic plate according to the present invention.
Figure 9B:
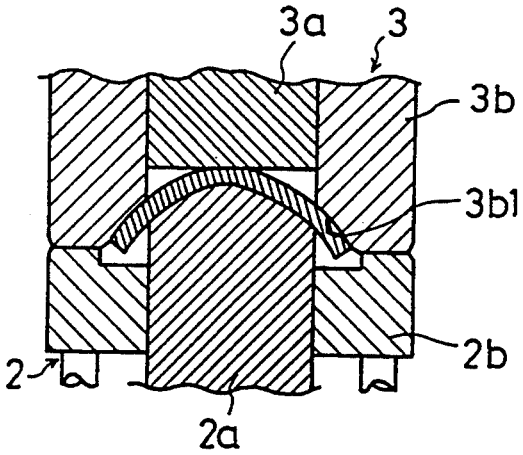

As shown in FIG. 9A in which a curving (drawing) step is shown, a circular flat metallic blank 1 is set on a lower mold 2 having a punch 2*a* and a punch holder 2*b*, and a press machine is operated such that the lower mold 2 and an upper mold 3 having a die 3*a* and a die holder 3*b* approach to each other. As shown in FIG. 9B, the metallic blank 1 is then drawn in its entirety in the boss projecting direction such that the metallic blank 1 is convexly curved substantially in the form of a circular arc in section. The shape in which the metallic blank 1 is curved, is determined by the tip shape of the punch 2*a* of the lower mold 2 and an inlet tapering surface 3*b*1 of the die holder 3*b* of the upper mold 3, likewise in the embodiment shown in FIG. 1A and FIG. 1B.

Figure 10:
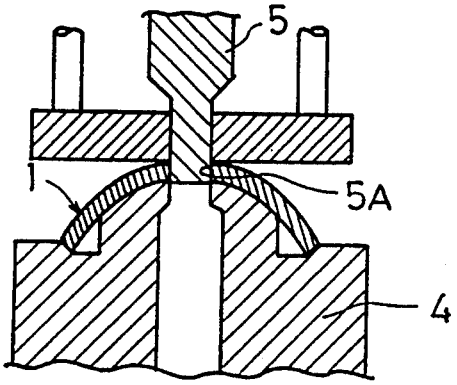
FIG. 10 is a section view of main portions of a punching step in the first method mentioned above.
Figure 11A:
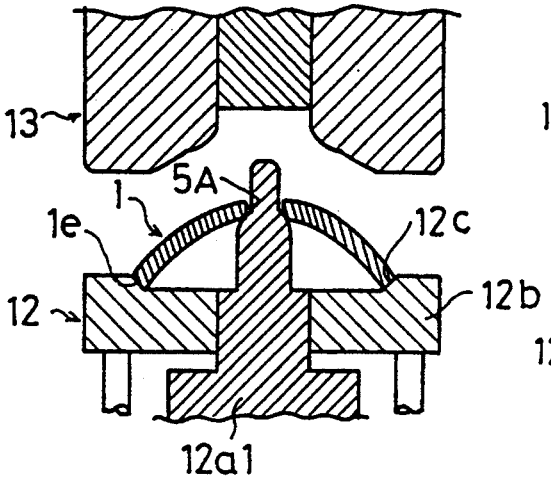
FIG. 11A and FIG. 11B are section views of main portions of a burring step in the first method mentioned above.
Figure 11B:
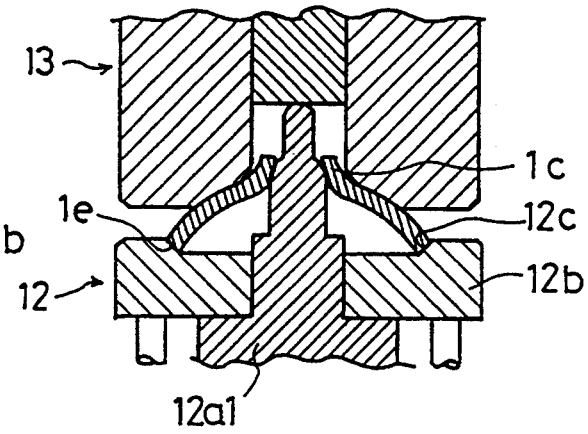

As shown in FIG. 10, the metallic blank 1 thus curved is held by a dedicated pierced holder 4 as mentioned earlier, and a hole 5A having a diameter of about 4 to about 5 mm is formed in the top of the metallic blank 1 with the use of a punching tool 5 such as a lathe, a drilling machine or the like.

Then, there are used molds different from those used in the curving (drawing) step mentioned above. More specifically, an outer peripheral edge portion 1*e* of the blank 1 which has been curved substantially in the form of a circular arc in section, comes in contact with the inner surface of an annular projection 12*c* of a punch holder 12*b* of a lower mold 12 to restrain the outer peripheral edge portion 1*e* from extending radially outwardly. In such a state, the lower mold 12 having a burring punch 12*a*1 and an upper mold 13 are caused to approach each other. Accordingly, a peripheral portion 1*c* in the vicinity of the hole 5A projects as bent in the convex direction of the blank 1.

Figure 12A:
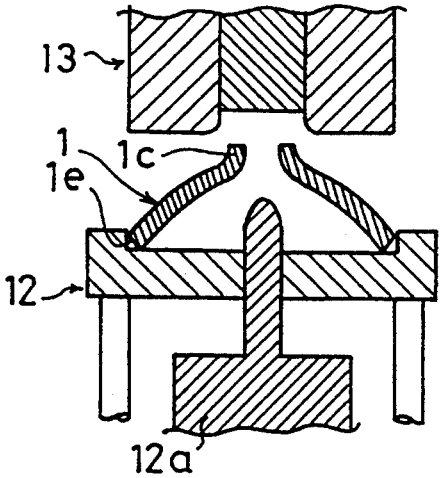
FIG. 12A and FIG. 12B are section views of main portions of a bending (squeezing) step in the first method mentioned above.
Figure 12B:
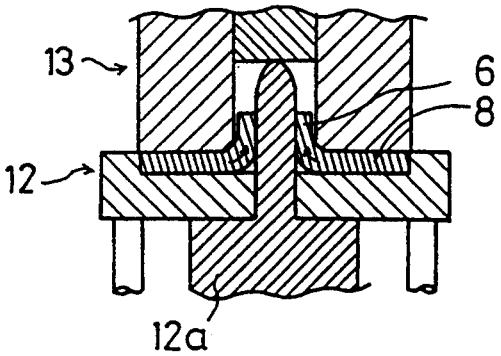

Then, the sequence proceeds to a bending (squeezing) step. As shown in FIG. 12A and FIG. 12B, a dedicated punch 12*a* is used, and upper and lower molds 13, 12 are caused to approach each other. Accordingly, an arcuate portion 1*b* of the blank 1 between an outer peripheral edge portion 1*e* and a hole peripheral portion 1*c* of the blank 1 to which a burring process has been subjected at the previous step, is squeezed and bent in the direction opposite to the convex direction thereof. As a result, a flat portion 8 is formed at the arcuate portion 1*b*, and the hole peripheral portion 1*c* is deformed along the outer peripheral surface of the punch 12*a*, thus forming a case-like boss 6 at the center of the blank 1. In this bending step, too, the outer peripheral edge portion 1*e* of the blank 1 comes in contact with the inner surface of an annular projection 12*c* of a punch holder 12*b* of the lower mold 12. Accordingly, the outer peripheral edge portion 1*e* is always restrained from extending radially outwardly. This perfectly prevents the material of the blank 1 from flowing in the radially outward direction, but causes the material of the blank 1 to flow toward the case-like boss 6. Accordingly, the case-like boss 6 can be securely thickened.

After the bending step mentioned above, the sequence proceeds to a boss finishing step. As shown in FIG. 13A and FIG. 13B, a dedicated finishing punch 12*a*2 and a die holder 13*b*2 are used to axially compress the end surface 6*a* of the case-like boss 6 such that the case-like boss 6 has a predetermined projecting height.

With the steps mentioned above, there is obtained, as shown in FIG. 14, an intermediate blank 10 for a poly-V pulley made of a metallic plate, which is integrally provided at the center thereof with the case-like boss 6 and also provided between the case-like boss 6 and the outer peripheral edge portion 1*e* with the flat portion 8. Then, the sequence proceeds to a step of forming a poly-V groove in an outer peripheral wall of the intermediate blank 10. The following description will discuss such a poly-V groove forming step.

First, there is conducted a step of thickening the outer peripheral wall portion in which a poly-V groove is adapted to be formed. As shown in FIG. 15, the intermediate blank 10 is held by and between a lower mold 14 and an upper mold 15, and a press machine is operated such that the upper and lower molds 15, 14 approach each other. Thus, the flat portion 8 of the intermediate blank 10 is pressed in the thickness direction thereof. This causes the material of the flat portion 8 to flow toward the outer peripheral side of the intermediate blank 10, so that an outer peripheral wall portion 10*a* of the intermediate blank 10 is thickened. At this time, there is substantially no gap around the case-like boss 6 and consequently, only a portion of the material of the flat portion 8 flows toward the case-like boss 6, so that the case-like boss 6 is hardly changed in height and thickness.

Then, the outer peripheral wall portion 10*a* thus thickened is subjected to a splitting step. As shown in FIG. 16, the flat portion 8 and case-like boss 6 of the intermediate blank 10 except for the thickened outer peripheral wall portion 10*a* thereof, are held by and between a rotary inner mold 16 and a rotary upper mold 17. By rotating the rotary inner mold 16 and the rotary upper mold 17, the intermediate blank 10 is rotated in the entirety thereof. A roller 18 is provided on the outer peripheral surface thereof with a V-shaped splitting projection 18*a*. The V-shaped splitting projection 18*a* is rotatingly pushed, from the outside of the intermediate blank 10, to the center portion of the thickened outer peripheral wall portion 10*a* of the intermediate blank 10 under rotation, such that the V-shaped splitting projection 18*a* bites into the outer peripheral wall portion 10*a* in the direction of the axis of rotation of the intermediate blank 10. Thus, a V-shaped split is formed in the outer peripheral wall portion 10*a*.

Figure 17:
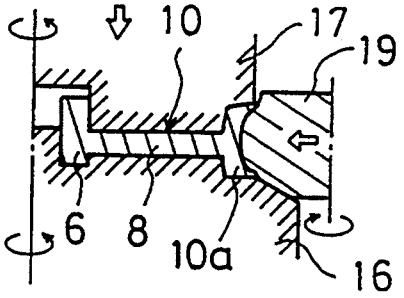
FIG. 17 is a half section view of main portions of a second rotatingly forming step in the first method mentioned above.

As shown in FIG. 17, while the whole intermediate blank 10 is rotated by rotating the rotary upper mold 17 and the rotary inner mold 16, a roller 19 for forming a wide outer peripheral wall is rotatingly pushed, from the outside of the intermediate blank 10, to the outer peripheral wall portion 10*a* having the V-shape split of the intermediate blank 10 under rotation. Thus, a wide outer peripheral wall portion 10*b* is formed at the outer periphery of the intermediate blank 10. The splitting step and the wide peripheral wall forming step may be simultaneously carried out with the use of the same molds, or may be individually carried out with the use of different molds. Further, each of the steps may be carried out one time or several times.

Figure 18:
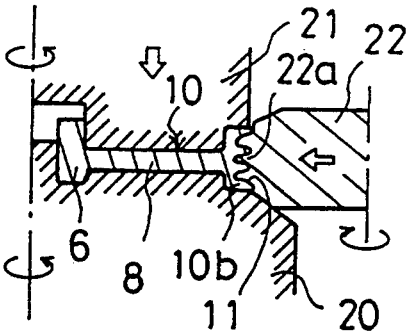
FIG. 18 is a half section view of main portions of a third rotatingly forming (poly-V groove forming) step in the first method mentioned above.

Finally, the sequence proceeds to the step of forming poly-V grooves in the wide outer peripheral wall portion 10*b*. As shown in FIG. 18, the flat portion 8 and the case-like boss 6 of the intermediate blank 10 except for the wide outer peripheral wall portion 10*b* thereof, are held by and between a rotary inner mold 20 and a rotary upper mold 21. By rotating the rotary inner mold 20 and the rotary upper mold 21, the intermediate blank 10 is rotated in the entirety thereof. A roller 22 is provided on the outer peripheral surface thereof with a concave/convex forming portion 22*a*. The concave/convex forming portion 22*a* is rotatingly pushed, from the outside of the intermediate blank 10, to the wide outer peripheral wall portion 10*b* of the intermediate blank 10 under rotation, such that the concave/convex forming portion 22*a* bites into the wide outer peripheral wall portion 10*b* in the direction of the axis of rotation of the intermediate blank 10. Thus, poly-V grooves 11 having a plurality of V-grooves are formed in the wide outer peripheral wall portion 10*b*. The poly-V grooves 11 may be formed in one rolling operation. However, the poly-V grooves 11 are preferably formed by a plurality of (2 to 4) rolling steps including a preliminary poly-V groove forming step and a finishing step by which poly-V grooves formed in the intermediate blank 10 after the preliminary poly-V groove forming step, are further rolled and so finished as to have depth and pitch as required.

As an embodiment of a second method of forming a pulley made of a metallic plate according to the present invention, the following will discuss a poly-V pulley forming method with reference to the attached drawings.

In this embodiment, until there is obtained, as shown in FIG. 14, the intermediate blank 10 for a poly-V pulley of a metallic plate integrally provided at the center thereof with the case-like boss 6 and also provided between the case-like boss 6 and the outer peripheral edge portion 1*e* with the flat portion 8, there are carried out steps identical with those discussed in the embodiment of the first method discussed in connection with FIG. 9A, FIG. 9B to FIG. 13A, FIG. 13B. Accordingly, with the description of these identical steps omitted, the following description will discuss steps to be carried out in the second method which are different from those in the first method, i.e., the steps of forming poly-V grooves in an outer peripheral wall portion of the intermediate blank 10.

Figure 19:
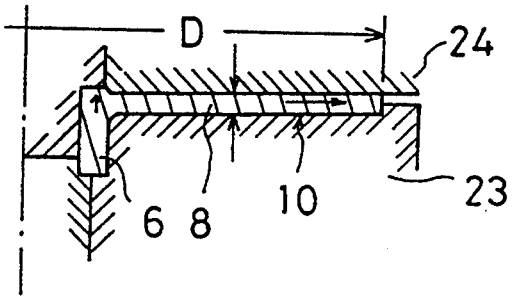
FIG. 19 is a half section view of main portions of a flat-portion pressing step in a second method of forming a pulley from a metallic plate according to the present invention.

First, the intermediate blank 10 is subjected to the step of pressing the flat portion. As shown in FIG. 19, a press machine is operated such that a lower mold 23 and an upper mold 24 by and between which the intermediate blank 10 is held, are caused to approach each other. Thus, the flat portion 8 of the intermediate blank 10 is pressed in the thickness direction thereof. This causes the material of the flat portion 8 to flow toward the outer peripheral side thereof such that the outer diameter D of the intermediate blank 10 becomes a predetermined diameter. At this time, there is substantially no gap around the case-like boss 6 and consequently, only a portion of the material of the flat portion 8 flows toward the case-like boss 6. Accordingly, the case-like boss 6 is hardly changed in height and thickness.

Figure 20:
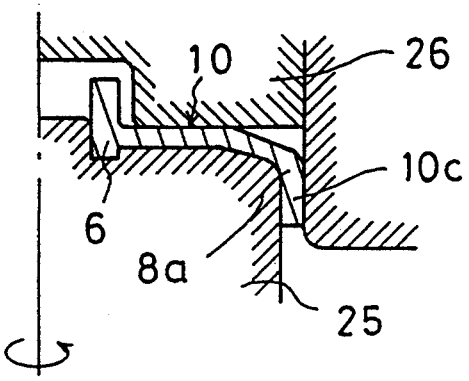
FIG. 20 is a half section view of main portions of a peripheral-wall forming step in the second method mentioned above.

Then, the intermediate blank 10 is subjected to a peripheral wall forming step. That is, the press machine is operated such that a lower mold 25 and an upper mold 26 as shown in FIG. 20 approach each other. Accordingly, an outer end portion 8*a* of the flat portion 8 as pressed during the previous step, is bent in one direction along the axis of rotation of the pulley, more specifically, in the direction opposite to the direction in which the case-like boss 6 projects. Thus, there is formed a poly-V groove forming peripheral wall portion 10*c*.

Figure 21:
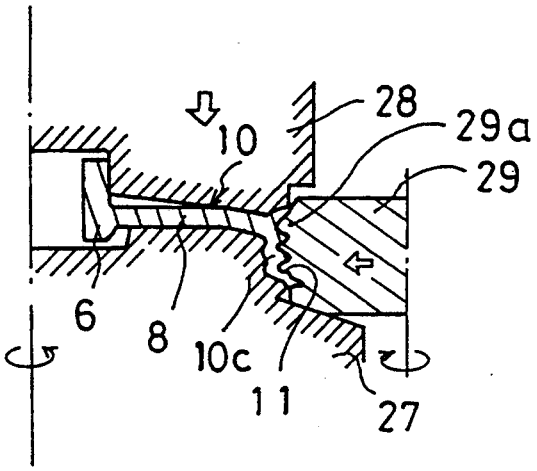
FIG. 21 is a half section view of main portions of a poly-V groove forming step in the second method mentioned above.

Finally, the sequence proceeds to the step of forming poly-V grooves in the poly-V groove forming peripheral wall portion 10c thus formed. This poly-V groove forming step is similar to that in the first method shown in FIG. 18. More specifically, as shown in FIG. 21, the flat portion 8 and case-like boss 6 of the intermediate blank 10 except for the poly-V groove forming peripheral wall portion 10c thereof, are held by and between a rotary inner mold 27 and a rotary upper mold 28. By rotating the rotary inner mold 27 and the rotary upper mold 28, the intermediate blank 10 is rotated in the entirety thereof. A roller 29 is provided on the outer peripheral surface thereof with a concave/convex forming portion 29a. The concave/convex forming portion 29a is rotatingly pushed, from the outside of the intermediate blank 10, to the poly-V groove forming peripheral wall portion 10c of the intermediate blank 10 under rotation, such that the concave/convex forming portion 29a bites into the intermediate blank 10 in the direction of the axis of rotation of the intermediate blank 10. Thus, poly-V grooves 11 having a plurality of V-grooves are formed in the poly-V groove forming peripheral wall portion 10c. As mentioned earlier, the poly-V grooves 11 may be formed in one rolling operation. However, the poly-V grooves 11 are preferably formed by a plurality of (2 to 4) rolling steps including a preliminary poly-V groove forming step and a finishing step by which poly-V grooves formed in the intermediate blank 10 by the preliminary poly-V groove forming step, are rolled and so finished as to have depth and pitch as required.

In the method of forming a boss on a plate-like metallic blank according to the present invention, there may be, of course, carried out a burring step (See FIG. 11) and a boss finishing step (See FIG. 13) which are similar to those shown in the first and second methods of forming a pulley from a metallic plate according to the present invention.

Further, in the first and second methods of forming a pulley from a metallic plate according to the present invention, the description has been made of a method of forming a poly-V pulley. However, each of the first and second methods may be applied to a method of forming a V-pulley having a single V-groove or may be used as a method of forming a flat pulley the peripheral wall of which is wide and flat.

The method of forming a boss on a plate-like metallic blank according to the present invention is adapted to integrally form, at the center of a plate-like metallic blank, a case-like boss which projects from one lateral side of the blank. More specifically, with the use of a small press machine, there can be securely formed a boss having a sufficient thickness and a sufficient projecting height even though the boss has a small inner diameter, such formation being made by a combination of kinds of bending operations so that the original thickness of the blank is not decreased so much in the course of production steps. With such a boss forming technology utilized, there is also provided a method of forming an economical pulley from a metallic plate such as a poly-V pulley with the number of production steps minimized.

What is claimed is:

1. A method of forming a case-like boss on a plate-like metallic blank to project from one lateral side of said blank, the method comprising the steps of:

curving a plate-like metallic blank such that the blank is convex in a direction in which the boss is adapted to project, the curved blank having a top, an arcuate portion and an outer portion;

punching a hole in the top of the curved blank; and bending the arcuate portion of the curved blank between the outer peripheral edge portion and a peripheral portion of the hole in the curved blank in the direction opposite to the convex direction thereof with the outer peripheral edge portion of the curved blank restrained from extending radially outwardly, so that a case-like boss is formed.

2. The method of forming a case-like boss on a plate-like metallic blank according to claim 1, further comprising a burring step between the curving and bending steps by which the hole peripheral portion is bent such that said hole peripheral portion projects in the convex direction of the curved blank.

3. The method of forming a boss on a plate-like metallic blank according to claim 1, further comprising a finishing step after the bending step by which the end surface of the case-like boss formed at said bending step is axially compressed, such that the case-like boss has a predetermined projecting height.

4. A method of forming a pulley from a metallic plate having a case-like boss projecting from one lateral side of the blank, said pulley having V-grooves formed in an outer peripheral wall portion of the blank, the method comprising the steps of:

curving a plate-like metallic blank such that the blank is convex in a direction in which the boss is adapted to project, the curved blank having a top, an arcuate portion and an outer peripheral edge portion;

punching a hole in the top of the curved blank;

bending the arcuate portion of the curved blank between the outer peripheral edge portion and a peripheral portion of the hole in the curved blank in the direction opposite to the convex direction thereof with the outer peripheral edge portion of the curved blank restrained from extending radially outwardly, so that a flat portion and a case-like boss are formed;

thickening an outer peripheral portion of the curved blank to form the outer peripheral wall portion by pressing the flat portion of the curved blank after said bending step, in the thickness direction thereof; and forming V-grooves in the thickened outer peripheral wall portion.

5. A method of forming a pulley made of a metallic plate having a case-like boss projecting from one lateral side of the blank, said pulley having V-grooves formed in an outer peripheral wall portion of the blank, the method comprising the steps of:

curving a plate-like metallic blank such that the curved blank is convex in a direction in which the boss is adapted to project, the curved blank having a top, an arcuate portion and an outer peripheral edge portion;

punching a hole in the top of the curved blank;

bending the arcuate portion of the curved blank between the outer peripheral edge portion and a peripheral portion of the hole in the curved blank in the direction opposite to the convex direction thereof with the outer peripheral edge portion of the blank restrained from extending radially outwardly, so that a flat portion and a case-like boss are formed;

pressing the flat portion of the curved blank after said bending step, in the thickness direction thereof such that the flat portion is so extended as to have a predetermined outer diameter;

forming the peripheral wall portion on the curved blank by bending the outer end side of the flat portion as pressed, in one direction along the axis of rotation of the pulley; and forming V-grooves in the peripheral wall portion.

* * * * *